United States Patent [19]

Santo

[11] Patent Number: 4,700,419

[45] Date of Patent: Oct. 20, 1987

[54] FLOATATION SLEEP SYSTEM INCLUDING A RECTILINEAR PERIMETER AIR CHAMBER

[76] Inventor: Philip J. Santo, 12 Mountin Rd., Rochester, N.Y. 14625

[21] Appl. No.: 936,635

[22] Filed: Dec. 1, 1986

Related U.S. Application Data

[63] Continuation-in-part of Ser. No. 782,938, Oct. 2, 1985, abandoned.

[51] Int. Cl.[4] ..... A47C 27/10

[52] U.S. Cl. ..... 5/452; 5/455; 5/458

[58] Field of Search ..... 5/452, 451, 450, 455, 5/449, 457, 458

[56] References Cited

U.S. PATENT DOCUMENTS 3,842,455 10/1974 Whitney ..... 5/452

*Primary Examiner*—Alexander Grosz

*Attorney, Agent, or Firm*—Lawrence P. Kessler

[57] ABSTRACT

An improved floatation sleep system of the type including a liquid-containing bladder, an air chamber surrounding the marginal perimeter of the bladder, and a substantially planar sheet interconnecting opposed portions of the air chamber. By this invention, the exterior of the air chamber is maintained in a substantially rectilinear configuration to yield the desirable overall rectilinear appearance of conventional bedding. To provide overall rectilinearity of the air chamber, at least one tie member is secured at one end to the inside surface of the exterior wall of the air chamber. The opposite end of the tie member is secured to a portion of the wall of the air chamber coextensive with the plane of the interconnecting sheet. Such interconnection is effected, for example, at a distance measured from the vertical projection of a line through the intersection of such one end of the tie member with the exterior wall on the plane of such sheet substantially equal to at least the distance from such intersection to such plane. The tie member thus prevents substantial deviation of the exterior wall from its rectilinear configuration.

24 Claims, 11 Drawing Figures

FLOATATION SLEEP SYSTEM INCLUDING A RECTILINEAR PERIMETER AIR CHAMBER

BACKGROUND OF THE INVENTION

Related Applications

This application is a continuation-in-part of U.S patent application Ser. No. 782,938, filed Oct. 2, 1985 now abandoned.

This invention relates generally to floatation sleep systems including perimeter air chambers, and more particularly to a floatation sleep system including a perimeter air chamber with substantially overall rectilinear side walls.

Floatation sleep systems, commonly referred to as waterbeds, have become a popular alternative to conventional bedding. Such popularity is due to the fact that waterbeds provide totally balanced body support, which has been found to induce a superior station of relaxation. The first waterbeds were free standing flexible bladders filled with water. However, since the free standing bladder was flexible in all directions, it was necessary that it have a vertical dimension (height) sufficient to prevent "bottoming out" when the body was supported on the bladder. This height made it awkward to get on and off the bladder, and the fact that the side walls of the bladder were flexible made sitting on the edge of the bladder difficult. Therefore, a rigid frame, located around the lateral marginal edges of the flexible bladder, was added. While the frame supported the bladder to maintain its desired height and prevent bottoming out, sitting on the edge of the bladder and getting on and off thereof over the frame was still uncomfortable.

In order to improve the comfort of the waterbed, the frame was replaced by a perimeter air chamber surrounding the lateral marginal edges of the flexible bladder, such as shown in U.S. Pat. Nos. 3,778,852 issued Mar. 21, 1978 in the name of Philips, and 4,070,473 issued Dec. 18, 1983 in the name of Penn et al, for example. The perimeter air chamber provided comfort when entering and exiting the bed and when sitting on the edge thereof, and in addition maintained the flexible bladder at a desired height to prevent its bottoming out.

More recently, I have improved the perimeter air chamber type floatation sleep system by separating the water-containing bladder from the perimeter air chamber (see my U.S. Pat. No. 4,513,463 issued Apr. 30, 1985). By this patented arrangement, bladders or perimeter air chambers may be selectively interchanged upon damage to one or the other, or whenever a change in the functionally or feel of the bladder or chamber is desired. As with other typical perimeter air chambers floatation sleep systems however, the sidewalls of the perimeter chamber are rounded in the vertical direction due to the nature of the chamber and the air pressure therewithin. This has, in some instances, proven to be a drawback to users who prefer the overall rectilinear appearance of conventional bedding.

SUMMARY OF THE INVENTION

This invention is directed to an improved floatation sleep system of the type including a liquid-containing bladder, an air chamber surrounding the marginal perimeter of the bladder, and a substantially planar sheet interconnecting opposed portions of the air chamber. By this invention, the exterior of the air chamber is maintained in a substantially rectilinear configuration to yield the desirable overall rectilinear appearance of conventional bedding. To provide overall rectilinearity of the air chamber, at least one tie member is secured at one end to the inside surface of the exterior wall of the air chamber. The opposite end of the tie member is secured to a portion of the wall of the air chamber coextensive with the plane of the interconnecting sheet. For example, such interconnection is at a distance measured from the vertical projection of a line through the intersection of such one end of the tie member with the exterior wall on the plane of such sheet substantially equal to at least the distance from such intersection to such plane. The tie member thus prevents substantial deviation of the exterior wall from its rectilinear configuration.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
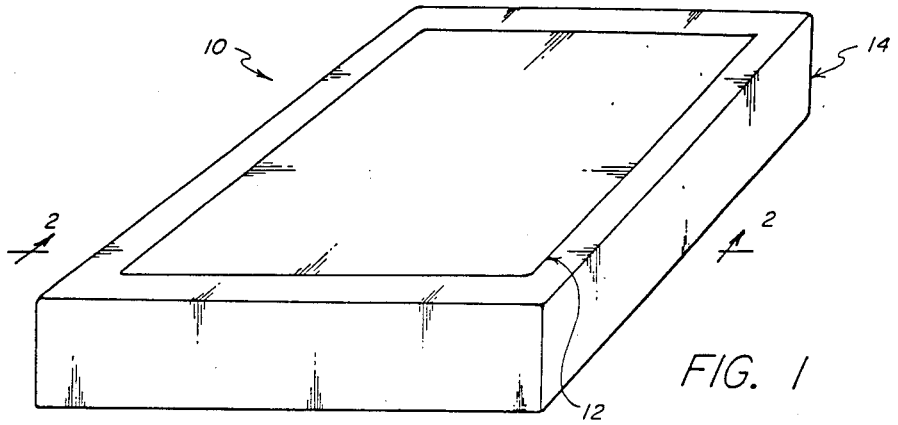
FIG. 1 is a view, in perspective, of a floatation sleep system including marginal perimeter air chamber of overall rectilinear configuration according to this invention.
Figure 2:
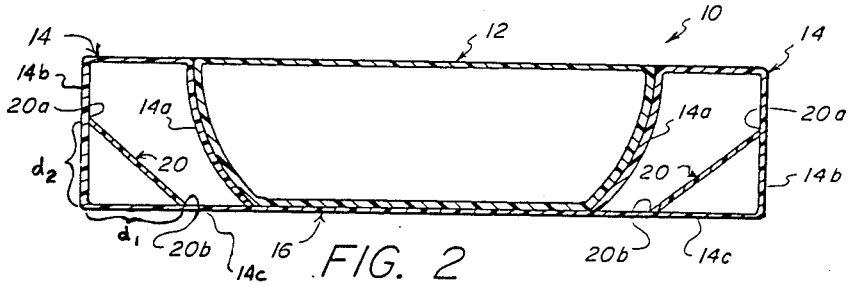
FIG. 2 is an end elevational view, in cross-section, of the floatation sleep system, taken along lines 2—2 of FIG. 1.

Referring now to the accompanying drawings, FIGS. 1 and 2 show a floatation sleep system designated generally by the numeral 10. The sleep system 10 includes a liquid-containing bladder 12, a marginal perimeter support air chamber 14, and a liquid-retaining liner 16. The bladder 12 is formed of flexible, dimensionally stable, liquid impervious material, such as polyethylene or polypropylene for example. Typically, the liquid contained in the bladder 12 is water, but other liquids or combinations of water and wave reducing agents, such as fiber mats, are suitable for use with this invention.

The perimeter air chamber 14 is formed of a similar flexible, dimensionally stable material. The chamber 14 comprises a sealed tube, or a plurality of interconnected sealed tubes, configured to surround the marginal perimeter of the bladder 12 to support the perimeter of the bladder. The tube(s) is adapted to contain a support mechanism, such as pressurized air for example, admitted to the tube by a valve (not shown). The interior wall 14a (i.e., facing the marginal perimeter of the bladder) preferably provides a support for a portion of the liquid-containing bladder 12 in the manner more fully described in my copending U.S. patent application Ser. No. 769,015, filed Aug. 26, 1985, now U.S. Pat. No. 4,663,790. As shown in such application, the liner 16 is integrally formed with the perimeter air chamber and extends in a plane beneath the bladder, between opposed marginal perimeter supporting portions thereof, to capture any liquid which escapes from the bladder. Of course, other configurations of the wall 14*a* and liner 16, such as the wall being substantially vertical with respect to the liner, or the liner being a separate sheet of flexible, dimensionally stable, liquid impervious material, are suitable for use with this invention.

The exterior wall 14*b* of the perimeter air chamber 14 is configured during manufacture so that when the air chamber is in an unpressurized state the exterior wall is substantially rectilinear. As described above, it is desired to maintain such overall rectilinearity when the perimeter air chamber is pressurized so that the sleep system 10 has the appearance of conventional bedding. In order to maintain such overall rectilinearity, according to this invention, at least one tie member 20 is provided. The tie member 20 is formed of an elongated sheet of flexible, dimensionally stable material similar, for example, to the material used to form the perimeter air chamber. Marginal edges 20*a*, 20*b* of the tie member 20 are respectively secured, such as by heat sealing for example, to the inside surface of the exterior wall 14*b* and to the the wall 14*c* of the perimeter air chamber which is coextensive with the plane described by the liner 16.

Figure 3:
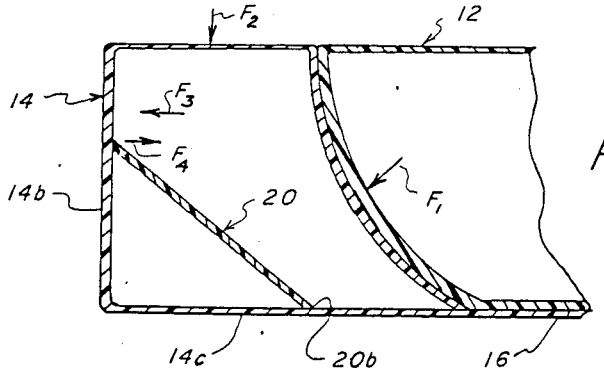
FIG. 3 is a cross-sectional end elevational view, on an enlarged scale, of a portion of the floatation sleep system showing the member for maintaining overall rectilinearity according to this invention, and the forces acting on such member.

The locations at which the tie members 20 are secured to the air chamber are of particular significance in carrying out this invention. Particularly, in this embodiment the joining of edge 20*a* to the wall 14*b* is along a line located substantially at or above the approximate mid-point of the wall 14*b*; and, the joining of the edge 20*b* to the wall 14*c* is along a line located at a distance d, measured from the vertical projection of the line through the mid-point of the wall 14*b* on the plane described by liner 16 at least equal to the distance $d_2$ from the mid-point t the such plane (see Fig. 2). By such arrangement, the forces acting on the tie member 20 as shown in FIG. 3, maintain the rectilinearity of the air chamber. That is, the force $F_1$ exerted by the liquid in the bladder 12 and additionally the force $F_2$ exerted for example by a person sitting on the edge of the sleep system 10 over the perimeter air chamber 14 increase the pressure within the chamber. However, the interior wall 14*a* and the wall 14*c* (liner 16) are respectively backed up by the bladder 12 and a support platform (not shown) which are, for all intents and purposes, substantially immovable. Accordingly, the increase in pressure results in a force $F_3$ acting on the exterior wall 14*b*. However, since the tie member 20 is dimensionally stable and its edge 20*b* is at a particular fixed location, the force $F_3$ is counteracted by a force $F_4$ exerted by the tie member. This prevents any substantial deviation in the exterior wall 14*b* to maintain the rectilinear configuration thereof.

Figure 4:
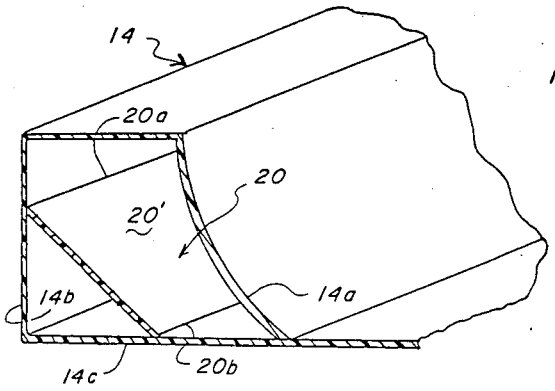
FIG. 4 is a view, in perspective and on an enlarged scale, of a portion of the perimeter air chamber and member for maintaining overall rectilinearity with portions removed to facilitate viewing.
Figure 5:
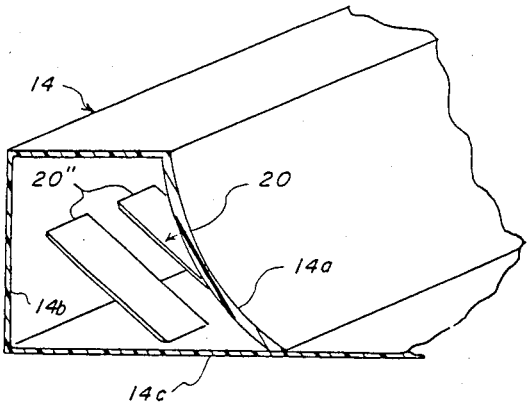
FIG. 5 is a view, similar to FIG. 4, showing a modified member for maintaining overall rectilinearity.

As shown in FIGS. 4 and 5 respectively, the tie member 20 may be a single sheet 20' or a plurality of discrete sheets 20''. With the use of a single sheet 20', such sheet may be sealed about all of its marginal edges to the perimeter air chamber 14. This enables the perimeter air chamber to be divided into two separately pressurizable zones (i.e., above the sheet and below the sheet). The pressure in such zones may be initially predetermined to be equal or different depending upon the desired feel of the perimeter air chamber 14. In either instance, the increase in pressure in the upper zone due to the force $F_2$ results in the force $F_3$ acting only on that portion of the exterior wall 14*b* above of the sheet 20'. On the other hand, the use of of a plurality of discrete sheets 20'' enables an increase in pressure in the perimeter air chamber 14 due to force $F_2$ to be distributed equally throughout the chamber.

Figure 6:
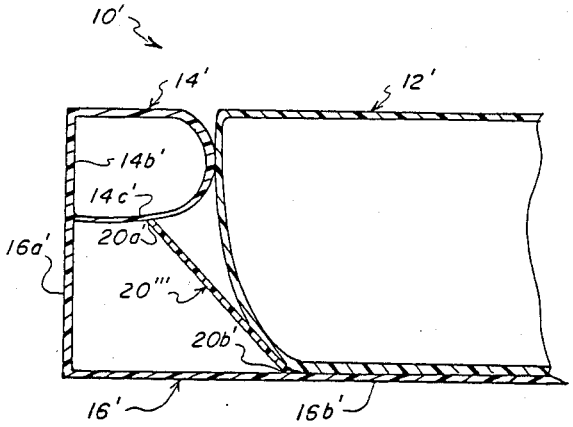
FIG. 6 is a view similar to FIG. 2 showing an alternate embodiment of the perimeter air chamber and the member for maintaining overall rectilinearity according to this invention.

FIG. 6 shows a floatation sleep system 10' which includes an alternate embodiment of the perimeter air chamber 14 and tie member 20 for the sleep system 10 of FIGS. 1–5. In such alternate embodiment, the perimeter air chamber 14' is located in support relation to the marginal perimeter of the bladder 12' adjacent to its upper portion. The liner 16', extending between opposed marginal perimeter supporting portions of the perimeter air chamber, includes substantially vertical legs 16*a'* coextensive with the exterior walls 14*b'* and a planar base 16*b'* beneath the bladder 12'. The base 16*b'*, legs 16*a'*, and the exterior wall 14*b'* are configured so that the sleep system 10' has the overall rectilinear appearance of conventional bedding. A tie member 20''' for maintaining overall rectilinearity is secured to a wall 14*c'* of the air chamber and the base 16*b'* of the liner 16'. As is the case in the embodiment of FIGS. 1–5, the joining of the tie member 20''' to the wall 14*c'* is vertically located along a line at or above the mid-point of the coextensive exterior wall 14*b'* and the leg 16*a'*, and the joining of the tie member to the base 16*b'* is located along a line at a distance measured from the vertical projection of the line through the mid-point on the plane described by the base, at least equal to the distance from the mid-point to such plane. Therefore, the tie member 20''' acts similarly to maintain the overall rectilinear appearance of the sleep system 10'. Moreover, the tie member 20''' can be used to support a portion of the bladder 12' and retain the air chamber in support relation with the marginal perimeter of the bladder in the manner described in the aforementioned U.S. Pat. No. 4,513,463.

Figure 7:
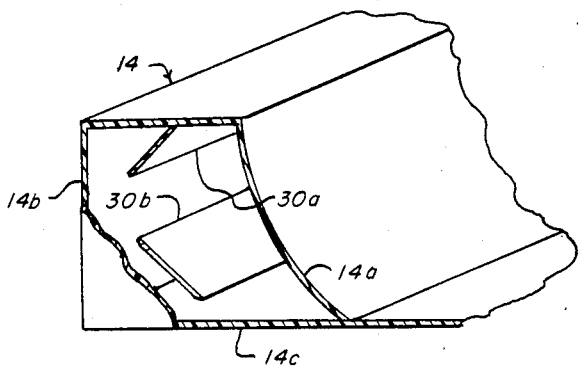
FIG. 7 is a view, similar to FIG. 4, showing a modified member for maintaining overall rectilinearity.
Figure 8:
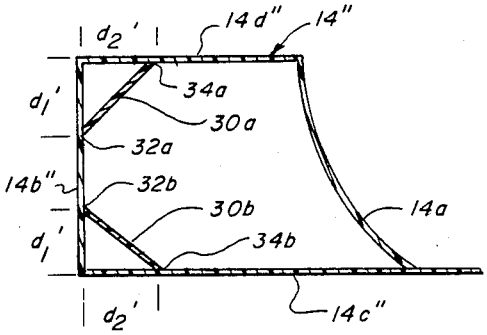
FIG. 8 is an end elevational view, in cross-section, of a portion of the floatation sleep system including the modified member of FIG. 7.

In still another alternate embodiment of the perimeter air chamber of this invention, as shown in FIGS. 7 and 8, the alternate perimeter support air chamber 14'' contains a plurality of tie members 30*a*, 30*b* for maintaining the chamber in its rectilinear configuration. The tie members 30*a*, 30*b*, which are formed for example of a similar material as that used to form the tie members of the embodiments of FIGS. 1–5, are respectively interconnected between the inside surface of the exterior marginal perimeter wall 14*b''* and the upper and lower walls 14*d*″, 14*c*″. The interconnection, which is accomplished by heat sealing for example, is made at particularly selected locations to provide the necessary forces on the walls of the perimeter air chamber 14″ to maintain its rectilinearity in the manner similar to that described above with reference to the embodiment of FIGS. 1–5. Specifically, the joining of one edge of the tie members 30*a*, 30*b* to the perimeter wall 14*b*″ is effected respectively along the lines 32*a*, 32*b* at approximately a distance $d_1'$ one-third of the wall 14*b*″ from its top and bottom, and the the joining of the opposite edges of the tie members respectively to the upper and lower walls is respectively effected along lines 34*a*, 34*b* at approximately an equal distance $d_2'$ from the vertical projections of the first mentioned lines respectively on the upper and lower walls. Accordingly, as in the embodiment of FIGS. 1–5, the tie members 30*a*, 30*b* counteract the forces tending to bow the marginal perimeter wall outwards and maintain the marginal perimeter air chamber 14″ in its substantially rectilinear configuration. Of course, the tie members 30*a*, 30*b* could be formed as one continuous member joined to the marginal perimeter wall at similar locations to that shown in FIG. 7 and 8, or at one central location as that shown in FIGS. 2–5.

Figure 9:
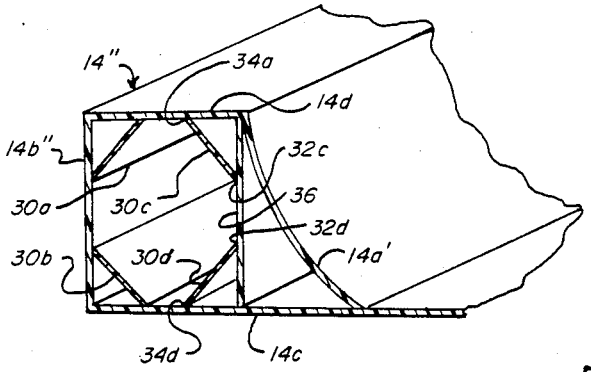
FIG. 9 is a view, similar to FIG. 4, showing a modified member for maintaining overall rectilinearity.
Figure 10:
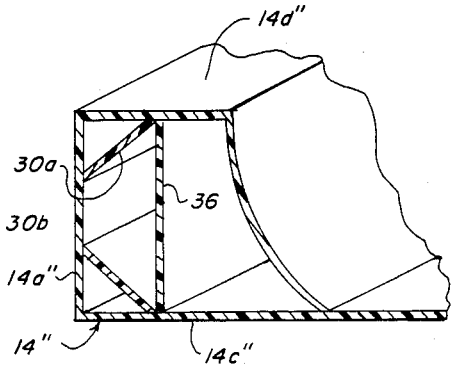
FIG. 10 is a view, similar to FIG. 4, showing an alternate location for the additional wall of the modified member for maintaining overall rectilinearity of FIG. 9.

An alternate embodiment of the perimeter air chamber of this invention as described with reference to FIGS. 7 and 8 is shown in FIGS. 9 and 10. In the embodiment of FIGS. 9 and 10, an additional wall 36 is provided. The wall 36, which is formed for example of a material similar tothat of the other walls of the perimeter air chamber 14″, is substantially parallel to the exterior wall 14*b*″ and is joined to the upper and lower walls 14*d*″, 14*c*″, such as by heat sealing for example. Such additional wall 36 may be spaced any desired distance from the exterior wall 14*b*″. In the arrangement shown in FIG. 9, additional tie members 30*c*, 30*d* respectively interconnect the additional wall 36 with the upper and lower walls 14*d*″, 14*c*″. The tie members 30*c*, 30*d* are similarly joined to the wall 36 (such as by heat sealing) along lines 32*c*, 32*d* located approximately a distance one third of the wall 36 from is top and bottom; and respectively to the upper and lower walls 14*d*″, 14*c*″ along lines 34*c*, 34*d* located approximately a substantially equal distance from the vertical projections of the lines respectively on the upper and lower walls. These additional tie members 30*c*, 30*d* further assure that the rectilinearity of the perimeter containment chamber is maintained.

Figure 11:
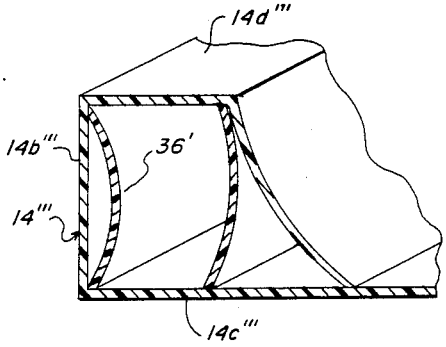
FIG. 11 is a view, similar to FIG. 4, showing an alternate embodiment of the perimeter air chamber and the member for maintaining overall rectilinearity according to this invention.

In the arrangement shown in FIG. 10, the additional wall 36 is connected tot he upper and lower walls 14*d*″, 14*c*″ respectively along the line where the tie members 30*a*, 30*b* join the upper and lower walls. The additional wall 36, whether in the location shown in FIG. 9 or FIG. 10, enable the perimeter air chamber to be divided into individual compartments which may respectively contain alternate support mediums (i.e., air, foam, water, etc.). For example, if the compartment most closely associated with the floatation sleep system bladder is filled with water, the effect is an extension of the water-containing sleep surface. With the particular constructional arrangement of the embodiment of FIGS. 9 and 10, the marginal perimeter support chamber 14″ and the liquid-containing bladder 12″ may be formed as an integral unit without altering the overall rectilinear configuration of such combined unit. Further, as shown in the altenate embodiment of FIG. 11, the additional wall 36′ could be of a concave configuration. In such configuration, the additional wall is attached to the marginal perimeter wall 14*b*‴ adjacent to the upper wall 14*d*‴ and to the lower wall 14*c*‴ adjacent to the wall 14*b*‴. The additional wall 36′ thus serves the function of the tie members to maintain the rectilinearity of the perimeter air chamber.

The invention has been described in detail with particular reference to preferred embodiments thereof, but it will be understood that variations and modifications can be effected within the spirit and scope of the invention.

I claim:

1. In a floatation sleep system including a liquid-containing bladder, an air chamber surrounding and supporting the marginal perimeter of said bladder, and substantially planar means for interconnecting opposed marginal perimeter supporting portions of said air chamber, means for maintaining the exterior of said air chamber in a substantially overall rectilinear configuration, said means comprising:

at least one tie member secured at one end to the inside surface of the exterior wall of said perimeter air chamber, and secured at its opposite end to a wall portion of said perimeter air chamber coextensive with said planar means.

2. The invention of claim 1 wherein said opposite end of said tie member is secured to said coextensive wall portion at a distance measured from the vertical projection of a line through the interconnection of said one end to said exterior wall on said coextensive wall portion substantially equal to at least the distance from such interconnection to such coextensive portion.

3. The invention of claim 2 wherein said one end of said tie member is secured to the inside surface of said exterior wall at or above the approximate mid-point thereof.

4. The invention of claim 3 wherein said tie member is an elongated sheet of flexible, dimensionally stable material secured along one marginal edge to said exterior wall and along the opposed marginal edge to said coextensive wall portion.

5. The invention of claim 4 wherein said elongated sheet is secured to said exterior wall and said coextensive wall portion in a manner to enable equalization of air pressure on both sides thereof.

6. The invention of claim 4 wherein said elongated sheet is secured to the exterior wall and said coexensive wall portion so as to form a pressurizable air chamber therebetween, the pressure in such chamber being equal to that in said perimeter air chamber.

7. The invention of claim 4 wherein said elongated sheet is secured to said exterior wall and said coextensive wall portion so as to form a pressurizable air chamber therebetween, the pressure in such formed chamber being different than the pressure in said perimeter air chamber.

8. The invention of claim 2 including a plurality of tie members, said tie members being secured at one end to the exterior wall of said perimeter air chamber and having their opposite ends respectively secured to the upper and lower walls of said perimeter air chamber.

9. The invention of claim 8 wherein said tie members are secured to the exterior wall respectively along lines at approximately one-third of the exterior wall from the upper and lower wall.

10. The invention of claim 9 wherein said tie members are secured to the upper and lower walls at a distance measured from the vertical projection of the line through the interconnection of said tie members with said exterior wall on the upper and lower walls substantially equal to at least the distance from such interconnection to the upper and lower walls respectively.

11. The invention of claim 1 wherein said tie member is an elongated sheet restrained in a concave configuration with one end of such sheet being secured to said exterior wall adjacent to an upper wall of said perimeter air chamber, and its opposite end being secured to said coextensive wall portion adjacent to said exterior wall.

12. An improved floatation sleep system in which a liquid-containing bladder is adapted to be received within a containment chamber including an air chamber supporting the marginal perimeter of said bladder and a liquid-retaining liner connected to said air chamber and lying substantially in a plane beneath said bladder, the improvement comprising:

means for maintaining said perimeter air chamber in an overall rectilinear configuration, said means including at least one member coupled between an inside surface of the exterior wall of said perimeter air chamber and a wall portion of said perimeter air chamber coextensive with the plane described by said liner, said member being responsive to external pressure exerted on said perimeter air chamber to prevent said exterior wall from deviating substantially, on exertion of such external pressure, from its rectilinear configuration.

13. The invention of claim 12 wherein said member is coupled to said coextensive wall portion at a distance measured from the vertical projection of a line through such interconnection of said member with said exterior wall on the coextensive portion substantially equal to at least the distance from such interconnection to such coextensive portion.

14. The invention of claim 13 wherein said member is an elongated sheet of flexible, dimensionally stable material secured along one marginal edge to said exterior wall and along the opposed marginal edge to said coextensive portion.

15. The invention of claim 14 wherein said elongated sheet is secured to said exterior wall and said coextensive portion in a manner to enable equalization of air pressure on both sides thereof.

16. The invention of claim 14 wherein said elongated sheet is secured to said exterior wall and said coextensive portion so as to form a pressurizable air chamber therebetween, the pressure in such formed chamber being equal to that in said perimeter air chamber.

17. The invention of claim 14 wherein said elongated sheet is secured to the exterior wall and said coextensive portion so as to form a pressurizable air chamber therebetween, the pressure in such formed chamber being different than the pressure in said perimeter air chamber.

18. The invention of claim 14 wherein said one end of said tie member is secured to the inside surface of said exterior wall at or about the approximate mid-point thereof.

19. The invention of claim 14 including a plurality of tie members, said tie members being secured at one end to the exterior wall of said perimeter air chamber and having their opposite ends respectively secured to the upper and lower walls of said perimeter air chamber.

20. The invention of claim 19 wherein said tie members are secured to the exterior wall respectively along lines at approximately one-third of the exterior wall from the upper and lower wall.

21. The invention of claim 20 wherein said tie members are secured to the upper and lower walls at a distance measured from the vertical projection of the line through the interconnection of said tie members with said exterior wall on the upper and lower walls substantially equal to at least the distance from such interconnection to the upper and lower walls respectively.

22. The invention of claim 19 further including an additional wall member within said perimeter air chamber, said additional wall member being substantially parallel to said exterior wall and coupled to said upper and lower walls of said perimeter air chamber to divide said chamber into separate compartments.

23. The invention of claim 22 further including additional tie members secured at one end to said additional wall member and having their opposite ends respectively secured to the upper and lower walls of said perimeter air chamber.

24. The invention of claim 12 wherein said tie member is an elongated sheet restrained in a concave configuration with one end of such sheet being secured to said exterior wall adjacent to an upper wall of said perimeter air chamber, and its opposite end being secured to said coextensive wall portion adjacent to said exterior wall.

* * * * *